United States Patent [19]

Luke

[11] Patent Number: 4,901,387

[45] Date of Patent: Feb. 20, 1990

[54] MATTRESS OVERLAY WITH INDIVIDUAL FOAM SPRINGS

[76] Inventor: John K. Luke, 420 Sweetwater Rd., Greer, S.C. 29651

[21] Appl. No.: 170,819

[22] Filed: Mar. 21, 1988

[51] Int. Cl.[4] ..... A47C 27/14; A61G 7/04

[52] U.S. Cl. ..... 5/464; 5/468; 5/481

[58] Field of Search ..... 5/481, 468, 464, 448, 5/420; 297/DIG. 1

[56] References Cited

U.S. PATENT DOCUMENTS

| | | | |
|---|---|---|---|
| 2,785,739 | 3/1957 | McGregor et al. | 5/481 |
| 3,016,317 | 1/1962 | Brunner | 5/481 |
| 3,222,697 | 12/1965 | Scheermesser | 5/481 |
| 4,070,719 | 1/1978 | Morgan | 5/481 |
| 4,603,445 | 8/1986 | Spann | 5/481 |
| 4,665,573 | 5/1987 | Fiore | 5/464 |
| 4,686,724 | 8/1987 | Bedford | 5/468 |
| 4,741,058 | 5/1988 | Williams et al. | 5/481 |
| 4,768,251 | 9/1988 | Baskent | 5/481 |
| 4,809,374 | 3/1989 | Saviez | 5/468 |

FOREIGN PATENT DOCUMENTS

81/02384 9/1981 PCT Int'l Appl. ..... 5/464

*Primary Examiner*—Alexander Grosz

[57] ABSTRACT

A foam overlay (A,A') is disclosed which includes a rectangular base (C) and a plurality of individual and independently acting foam springs (B,B'). Each foam spring includes a base block (10,10') and a polyhedron body (14,14') atop each base block terminating in a planar support surface (12,12'). The foam springs are close enough to each other, yet separated sufficiently that they each act individually and independently. The foam springs may act together to support heavier portions of the body, but act independently in support of lighter body portions. Medical overlay pad (A') includes a main support section (32) and a secondary support section (30) of shorter foam springs D. Foam springs (B') of main section (32) support at a higher level than foam springs (D) of secondary support section (30). This allows pressure to be reduced on the lower extremities, such as the heel, during prolonged bed rest as well as on upper torso.

21 Claims, 4 Drawing Sheets

Fig. 1.
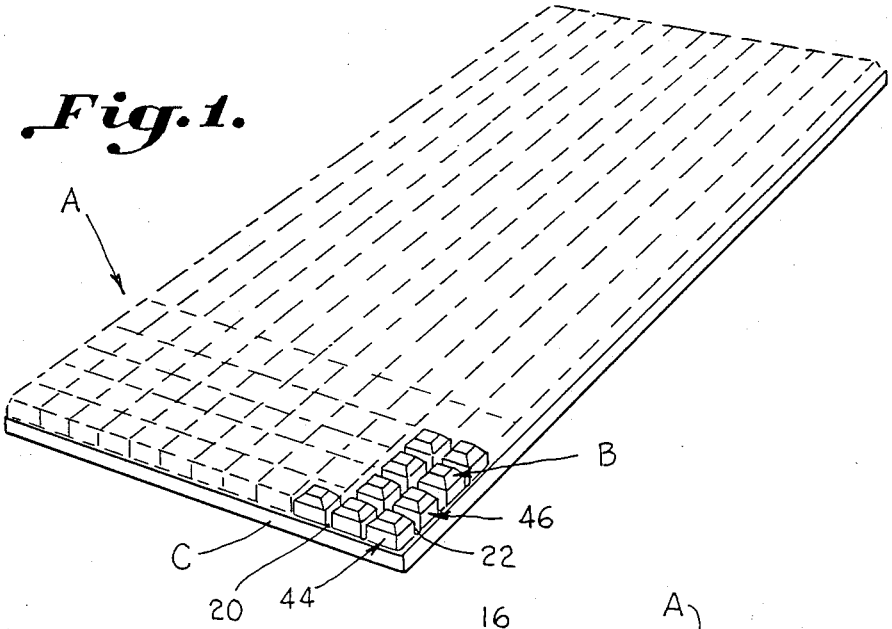
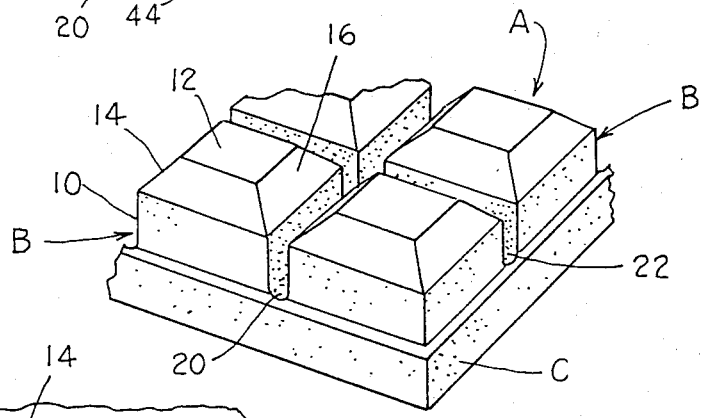
Fig. 2.
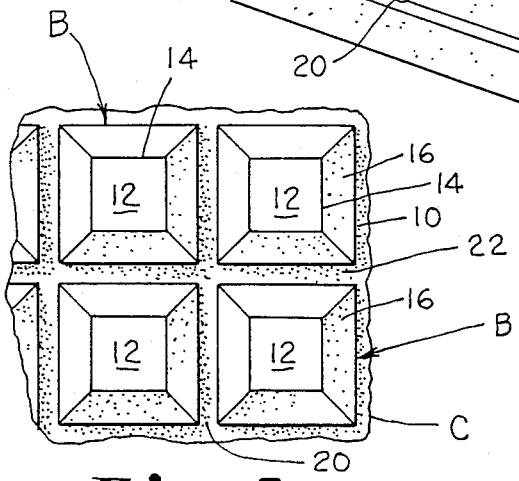
Fig. 3.

Fig. 6.
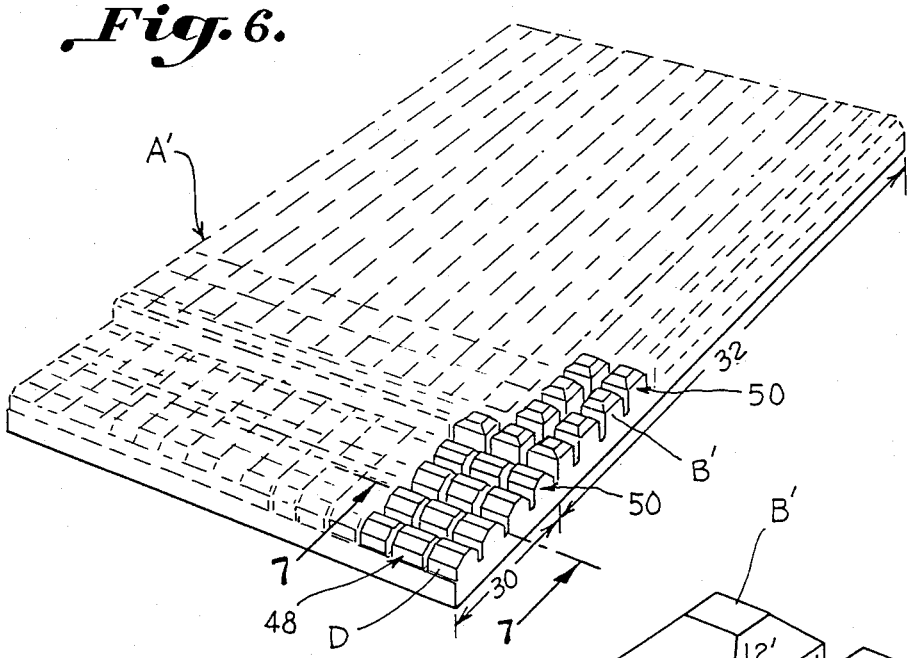
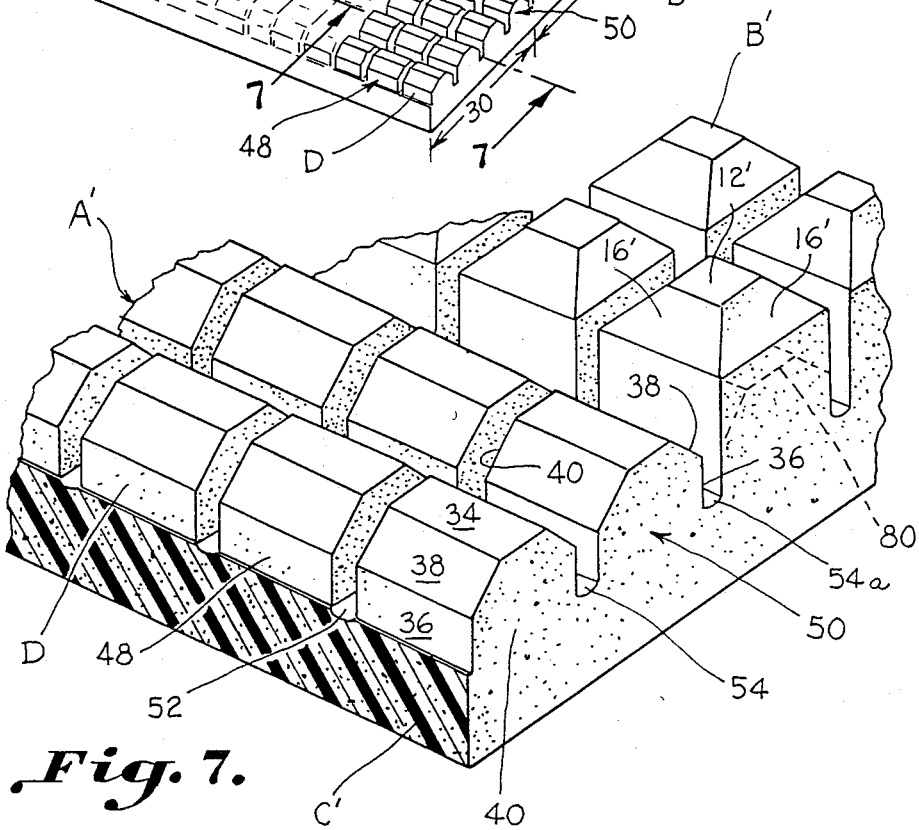
Fig. 7.

MATTRESS OVERLAY WITH INDIVIDUAL FOAM SPRINGS

BACKGROUND OF THE INVENTION

The invention relates to an overlay for a mattress or other support surface incorporating individual foam springs.

It has been known to provide overlays for mattresses and other support surfaces which include a foam pad with convoluted foam elements. The overlay is placed between the bottom sheet and mattress for support and comfort. When the cushion is used in medical applications, strategic pressure relief may also be obtained. Typical foam mattresses or overlays of the convoluted type are disclosed in U.S. Pat. No. 4,686,725. Other foam pads having convoluted foam elements that are truncated are disclosed in U.S. Pat. Nos. 4,673,452; 4,603,445; and 4,686,724. Various designs of these mattresses are typically constructed on a convoluter machine and the shape of the mattress elements may be determined by interchanging the rings of the convoluter machine. The convoluter machine takes a single blank of foam and cuts two mattress pads out of the blank. The problem arises in that a large amount of foam material is taken out of each individual pad due to the nature of the process. The result is that two convoluted foam mattresses are provided with limited cushioning and support as compared to the original foam blank due to the removal of foam material from each pad. For example, a 2 inch convoluted mattress pad requires a 2¼ inch foam blank, and 2 convoluted pads are produced from the blank. However, only about 50 percent of the foam material of the original 2¼ inch blank is in each pad. Due to this technique, there are considerable void spaces in the convoluted mattress and its cushioning ability is limited. The convoluted material tends to bottom out or flatten when laid upon. If it is desired to truncate the convoluted elements so that they are not as pointed, even more foam material is lost. To compensate, a higher density foam is needed. Since this is expensive, numerous types of filler materials have been used to enhance the cushion and support ability of convoluted pads. Another shortcoming of the convoluted type mattress overlay is that the convoluted elements are significantly interconnected together which makes it practically impossible for the convolutions to effectively act as individual spring elements.

It is also known to saw-out foam material to make mattress overlays. For example, it has been known to saw a foam blank into laterally extending form elements with slots in between. The lateral foam elements are then cut longitudinally and separated. From a cross-sectional view, the lateral elements in the center of the pad are wider than the lateral elements on the ends. Approximately 95 percent of the foam material is left in this type of mattress.

U.S. Pat. No. 4,383,342 discloses a molded mattress construction in which essentially all the foam material put into the product remains.

Accordingly, an object of the invention is to provide a foam overlay which primarily provides maximum support and comfort while secondarily provides maximum redistribution of body weight and pressure.

Accordingly, another object of the invention is to provide a mattress or cushion overlay having individual foam springs in which almost all of the foam material remains in the overlay.

Another object of the invention is to provide a foam overlay and method for a mattress or cushion having a plurality of foam springs which act individually and together as spring elements.

Another object of the invention is to provide a mattress or cushion overlay with individual foam springs which may be used to relieve pressure at strategic pressure points of a patient, in addition to providing comfort and support.

Another object of the invention is to provide a mattress or cushion overlay with individual foam springs which are arranged in such a manner that they act individually without interference from each other and act in groups to support heavier body portions in providing pressure relief and other comfort and support functions for patient and normal bed rest.

SUMMARY OF THE INVENTION

The above objectives are accomplished by an overlay which includes hundreds of intricately designed foam springs that have a unique top surface. This provides the correct level of support to different parts of the body by allowing the body to sink into the cushion, and thereby surrounding the body with "ultimate comfort". Each foam spring is about 2 inches wide, 1½ inches high, and 2 inches deep. There is an approximate ⅜ inch space between each spring on all four sides. This enables the foam spring to cradle each part of the body, and optimize the balance between support and comfort. The top of each foam spring is approximately half the size of its base. This reduces the flatness feeling of the cushion and enables each foam spring to cushion the various weights of each part of the body. Greater comfort is provided than geometrically flay-type cushions. A ⅜ inch channel separates each foam spring throughout the entire surface of the cushion. Optimum air circulation is provided underneath and around to keep the body cooler in summer and warmer in winter. Foam having a 1.4 to 1.5 pound density and 2 inch thickness is used. The density and thickness work in tandem with the special geometrical design to provide the best comfort. Sheets fit perfectly over the cushion and stay in place. The unique cell design and surface allows the body to sink into the cushion just enough for it to conform to the body's shape. Optimum support is provided for areas of the body that normally do not get support such as the small or lower part of the back, neck and shoulders. The overlay cushion provides the correct amount of support to areas of the body that need it, and it floats lighter parts of the body such as the feet. Unlike the convoluted pads, it does not flatten out and thus lose its support. And unlike other foam cushions that have flat surfaces, with the overlay design one does not sleep on top of the cushion, which is like sleeping on a plain, flat mattress. In accordance with the sleeping dynamics of the overlay, every part of the body is cradled with its weight gently dispersed through the special combination of foam content, geometric design, and density. The overlay is made from 100 percent pure polyurethane, and contains no fillers. A high density foam provides the highest level of comfortable support. As contrasted to the convoluted foam pad representing a one dimensional approach to creating comfort, the overlay provides a carefully formulated combination of factors developed to provide heretofore unachievable support and comfort characteristics.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view illustrating a foam overlay for a mattress and the like constructed in accordance with the present invention;

FIG. 2 is a partial perspective view illustrating a plurality of foam springs in a foam mattress overlay in accordance with the present invention;

FIG. 3 is a top plan view of individualized foam springs incorporated into a foam mattress overlay in accordance with the present invention;

FIG. 6 is a perspective view of another embodiment of a foam overlay for a mattress and the like constructed in accordance with the present invention;

FIG. 7 is an enlarged view taken along 7—7 of FIG. 6; and

DESCRIPTION OF A PREFERRED EMBODIMENT

Figure 4:
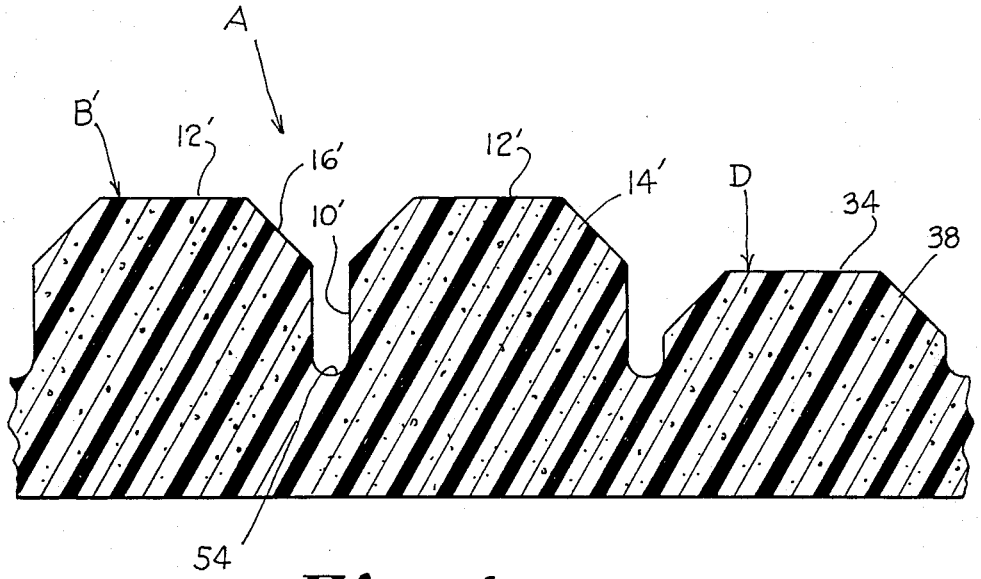
FIG. 4 is a sectional view taken at the junction of a main support section and a secondary support section of a medical foam mattress overlay constructed in accordance with the present invention.
Figure 5:
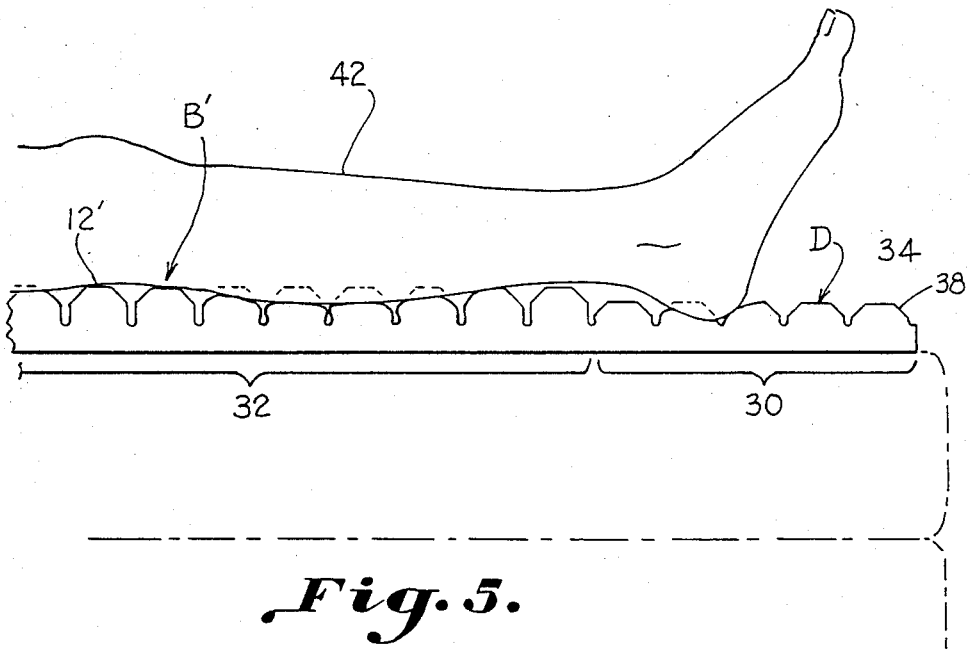
FIG. 5 is a side elevation illustrating a medical foam mattress overlay constructed in accordance with the present invention for supporting the lower extremities of a medical patient at a lower elevation than a main support section.

Referring now in more detail to the drawings, a foam overlay, designated generally as A, is provided for a mattress, cushion, and the like constructed from polyurethane foam such as 1.4 or 1.5 density foam material with an ILD in the 30 to 40 range. For the consumer and normal bed rest, the overlay is constructed having an overall thickness of approximately 2 inches to supplement cushioning and support. Individual foam springs, designated generally as B, have a square cross-section of approximately 2 inches and a height of approximately $1\frac{1}{4}$ inches. Overlay A for consumer use has an overall height of approximately 2 inches. Channels of approximately $\frac{1}{4}$ inch are formed in the foam material longitudinally and laterally to isolate each foam spring and provide air circulation. The foam overlay may be used as an overlay for a mattress or a like cushion to supplement the support and cushioning. The overlay may be used as a mattress or cushion by itself. In addition to supporting and cushioning a person's body, the overlay provides redistribution of body weight to reduce pressure at strategic points of the body and reduce the formation of decubitus ulcers in the case of prolonged bed rest when used by a medical patient.

As can best be seen in FIG. 2, overlay A includes a rectangular foam base C on which a plurality of individual foam springs B are carried. Each foam spring includes a rectangular base block 10 and a horizontally planar support surface 12 at a correct level for body support. A converging solid body in the form of a polyhedron 14 extends between base block 10 and planar surface 12. Polyhedron 14 includes 4 trapezoidal planar faces 16 which converge upwardly to planar surface 12. Preferably, the base of polyhedron 14 coextends with the perimeter of base block 10.

As can best be seen in FIG. 3, there are a plurality of longitudinal air channels 20 and lateral air channels 22 surrounding each individual foam spring B. Channels 20, 22 are dimensioned sufficiently so that foam springs B may act individually and together in groups to support, cushion, and relieve body pressure in an effective manner. For example, channels 20, 22 preferably have a width of approximately $\frac{1}{4}$ inch while a width in the range of $\frac{1}{8}$ to $\frac{3}{8}$ inch may be used. Preferably, base block 10 of foam springs B is a 2 inch square. The height of the foam spring for consumer use is approximately 1 to $1\frac{1}{2}$ inches. In one embodiment, a foam material of 1.4 to 1.5 pounds was used. The combination of geometric design, individualized foam springs, and density of foam material has been found to provide a highly effective foam overlay for cushioning, supporting, and reducing pressure. This combination floats the lighter parts of the body such as the feet while cradling and supporting the heavier parts of the body. Support surfaces 12 provide the correct level of support to the different parts of the body. The channels enable the foam springs to act individually and independently or in groups to support the heavier parts of the body. These individual springs can move in any direction without interfering with each other in a horizontal plane to significantly reduce pressure against the skin. In essence, the body is cushioned and moves with the surface as opposed to being moved against the surface which creates shearing or abrasion pressure on the skin.

FIGS. 4 through 7 illustrate another embodiment A′ of the invention for medical patient use. Overlay A′ includes an end, secondary support section 30 with foam springs D and a main support section 32 having foam springs B′. Foam springs B′ have the same configuration as springs B of overlay A, but are taller. Like elements are denoted by the same number with a prime. Foam springs B′ in section 32 are like springs B of overlay A, yet are larger. Springs B′ have a preferred height of about 2 to $2\frac{1}{2}$ inches above base C′ which has a preferred height of about $1\frac{1}{2}$ inches. The preferred total height of overlay A′ in main section 32 is about $3\frac{1}{2}$ inches. Springs B′ have a surface 12′ about $\frac{1}{2}$ to 1 inch above the level support of surfaces 34 of foam springs D, although this height level differential may vary without departing from the advantages. Springs D have lateral surfaces 36 sawed perpendicular to base C′, and inclined surfaces 38 terminating in planar support surface 34. Springs D have a preferred height of 1 to $1\frac{1}{2}$ inches and section 30 then has a height of about $2\frac{1}{2}$ to 3 inches. As can best be seen in FIG. 7, longitudinal surfaces 40 of springs D are planar and extend from base C′ to support surface 34, generally perpendicular. This is due to the method of making the overlay explained more fully below. With a patient 42 properly positioned, the lower extremities, e.g. feet and heels, are lightly supported by secondary section 30 due to the weight of the legs being supported at the calf and upper leg area by the main section 32. This alleviates and redistributes pressure on the troublesome heel, ankle, and other foot portions reducing decubitus ulcers.

In the foam overlays described above, the foam springs B are arranged in parallel, longitudinal and lateral rows 44, 46, respectively. In the case of medical foam overlay A' the foam springs B', D of the main and secondary support sections are arranged in parallel rows 48 and parallel rows 50 extending in first and second dimensions of the overlay. Grooves 52, 54 like grooves 20, 22 of overlay A extend longitudinally and laterally in overlay A'. It is important to note that the springs B, B', D in the respective rows of overlays A and A' occupy a space next adjacent each other so there are no void spaces on the overlay, except for grooves 20, 22 or 52, 54. The springs are arranged next adjacent each other, laterally and longitudinally, in the previously described rows. The foam springs of adjacent rows are in a uniform and immediate juxtaposed arrangement, as can best be seen in FIGS. 1 and 6. There are no alternating void spaces between the foam springs as occurs in convoluted pads. In this manner, the individualized foam springs B act individually and independently next adjacent one another in both dimensions of the overlay to effectively accommodate the support and comfort of the patient with reduced pressure. In particular, the support and pressure accommodation is provided at the sensitive body areas including the scapula, sacrum, trochanter, and heels.

Figure 8:
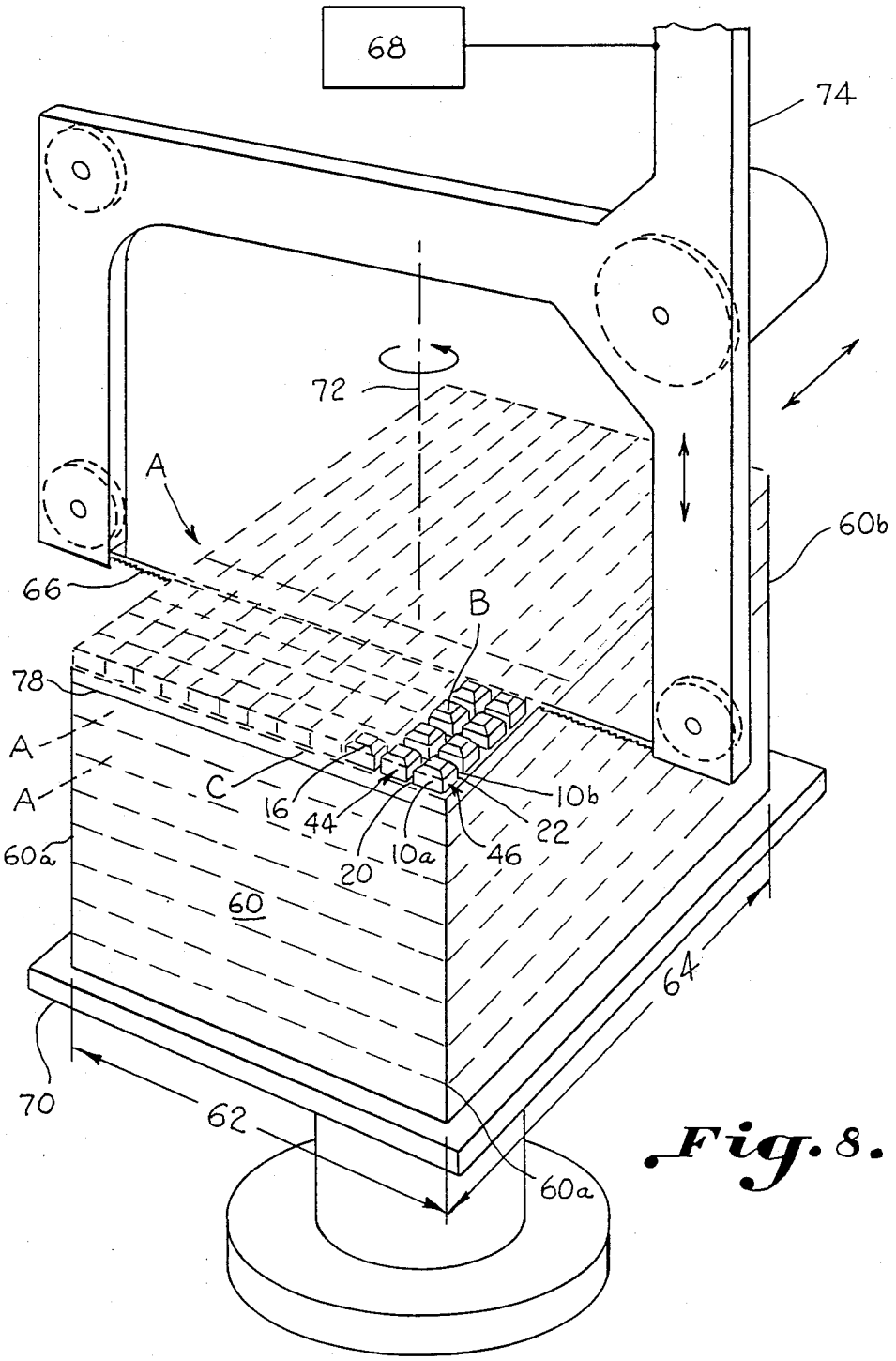
FIG. 8 is a perspective view illustrating a method for constructing a foam overlay for a mattress and the like in accordance with the present invention.

In accordance with the method, as can best be seen in FIG. 8, a blank foam block 60 having a first dimension (width) 62 and a second dimension (length) 64 equal to that of rectangular base C is fed longitudinally to the saw blade 66 of a computer controlled foam saw machine 68 as can best be seen in FIG. 6. Foam block 60 is supported on a turntable 70 so that the block may be rotated 90 degrees about axis 72. Saw blade 66 carried by housing 74 moves vertically and horizontally, and may tilt.

Beginning at one end 60*a* of block 60, a lateral row 46 of springs B is simultaneously formed by sawing. Lateral surfaces 10*a* of all base blocks 10 across the row is first formed by sawing. Next, lateral planar faces 16 are formed and then planar support surfaces 12 across first row 46 are formed. The opposing lateral planar faces 16 and sides 10*b* of the base blocks are formed. Next, lateral groove 22 is sawed across the pad. Lateral sides 10*a* of a next adjacent row 46 of base blocks 10 are then formed on the next lateral row of foam springs. All of the planar faces 16, top support surfaces 12, next adjacent planar faces 16, and the opposing lateral sides 10*b* of base blocks 10 are sawed. Another lateral channel 22 is sawed. This process continues along the entire length of the pad until all of the lateral surfaces and channels are sawed for all the lateral rows 46 of foam springs B. Block 40 is then rotated 90 degrees and fed laterally to saw the longitudinal surfaces of springs B and longitudinal channels 20. Longitudinal surfaces 10*c* and 10*d* of base blocks 10, faces 16 of polyhedrons 14, and channels 20 are sawed. This sawing is continued across the width of overlay A until all of the longitudinally extending surfaces of foam spring elements B of all longitudinal rows 44 are sawed and formed. Spring elements B and grooves 20, 22 are completed over the entire surface of overlay A. Saw blade 66 drops down and begins sawing of a next below overlay A. Blade 66 starts at a line 78 corresponding to the bottom surface of rectangular base C of a previously sawed overlay A. As the next overlay A is sawed, the bottom surface of the previously sawed overlay is formed by the sawing of springs B and grooves 20, 22 of the next overlay.

In the method of making medical overlay A', all the cuts in block 60 are formed first in the longitudinal direction instead of the lateral direction as described above. The longitudinal surfaces, support surfaces 12', and longitudinal grooves 52 are formed over the entire area of base C'. Next, the block is sawed in the longitudinal direction. The longitudinal surfaces of springs B' and lateral grooves 54 in main section 32 are sawed. Then, the saw is lowered ½ to 1 inch to saw spring D of secondary section 30 which is about 9 inches in length. When saw blade 66 drops down at lateral groove 54*a*, it cuts the tops and longitudinal inclined surfaces 16' of spring B', previously formed in section 30, off. This leaves the barn-shaped springs D', as can best be seen in FIG. 7. This cut-off is shown in dotted lines 80 in spring B' preceding groove 54*a*, for illustration purposes only. This is necessary in order to form the lower springs D of section 30.

While any suitable saw 66, 68 may be used, a computer contour saw manufactured by Fecken-Kirfel American, of 6 Leighton Place, Mahwah, N.J. 07430, as Model No. C428207 is particularly advantageous.

While a preferred embodiment of the invention has been described using specific terms, such description is for illustrative purposes only, and it is to be understood that changes and variations may be made without departing from the spirit or scope of the following claims.

What is claimed is:

1. A foam overlay for a mattress and the like constructed from a polyurethane foam material, said overlay having a support surface for evenly dispensing supporting pressure generally over a person's entire body while supported in a supine position, and said overlay comprising:

(a) a rectangular base;

(b) a plurality of foam springs one-piece with said base for supporting and cushioning the body of a person, and said foam springs covering substantially all of said supporting surface of said overlay;

(c) said foam springs including a rectangular block formed as one-piece with said rectangular base defined by generally vertical side walls extending upwardly from said rectangular base; and a convergent solid body extending from said side walls of said rectangular block converging upwardly to a horizontal planar support surface having a cross-section reduced in area relative to that of said rectangular block;

(d) a plurality of longitudinal and lateral channels formed between opposing side walls of adjacent rectangular blocks of adjacent foam springs separating said foam springs into individual foam springs; and (e) said channels being dimensioned in depth and width to space said foam springs apart laterally and longitudinally and effectively isolate said foam springs from one another to allow said foam springs to compress and deform independently for conforming to and supporting said person's body in said supine position without interference from and affecting adjacent foam springs in the vertical and horizontal planes while allowing said foam springs to act together in a group to support heavier portions of said person's body.

2. The foam overlay of claim 1, wherein said foam springs are arranged in parallel longitudinal and lateral rows and the foam springs of adjacent rows are in a uniform immediately juxtaposed arrangement in a manner that generally no spring void spaces exist over said overlay.

3. The foam overlay of claim 1, wherein said foam springs cover about 90 percent of the total surface area of said rectangular base and said planar support surfaces of said foam springs terminates in a common horizontal plane.

4. The foam overlay of claim 1, wherein said convergent solid body includes a polyhedron having trapezoidal bases terminating in said planar support surface.

5. The foam overlay of claim 4, wherein said planar support surface is square.

6. The foam overlay of claim 1, wherein said polyhedron has a base co-extending with said base block.

7. The foam overlay of claim 6, wherein said base block and polyhedron base are square.

8. The foam overlay of claim 1, wherein said channels have a width in a range of about $\frac{1}{8}$ to $\frac{3}{8}$ inch.

9. The foam overlay of claim 1, wherein said channels have a width of approximately $\frac{1}{4}$ inch.

10. The foam overlay of claim 9, wherein said foam springs have a height of about 2 inches.

11. The foam overlay of claim 1, wherein said foam springs have a height in the range of $1\frac{1}{2}$ to $2\frac{1}{2}$ inches.

12. The foam overlay of claim 11, wherein said base block is square and has planar sides in the range of $1\frac{3}{4}$ to $2\frac{1}{2}$ inches being generally of the same dimension as the height of said foam spring.

13. A foam mattress overlay having a support surface for evenly dispensing supporting pressure generally over a person's entire body while supported in a supine position, said overlay comprising:

(a) a rectangular foam base for overlaying a mattress and the like;

(b) a main support section formed on said base including a plurality of foam springs one piece with said base for supporting and cushioning the body of a person, and said foam springs covering substantially all of said supporting surface of said main support section;

(c) said foam springs including a rectangular block formed as one-piece with said rectangular base defined by generally vertical side walls extending upwardly from said rectangular base; a convergent solid body extending from said side walls of said rectangular block converging upwardly to a horizontal planar support surface having a cross-section reduced in area relative to that of said rectangular block and providing a first level of support for said patient's body;

(d) a secondary support section formed on said base including a second plurality of foam springs having a generally planar support surface at a second level lower than said first level for supporting the lower extremities of the body of a person supported on said overlay; and (e) a plurality of lateral and longitudinal channels separating said base blocks of at least said first plurality of foam springs to isolate said foam springs so that they act individually without interference from each other, yet act together in a group to support heavier portions of the body.

14. The overlay of claim 13, wherein said longitudinal channels commonly extend between said first and second plurality of foam springs.

15. The overlay of claim 13, wherein the support surfaces of said main and secondary support sections have a height difference in a range of about $\frac{1}{2}$ to 1 inch.

16. The foam overlay of claim 13, wherein said foam springs are arranged in parallel longitudinal and lateral rows and the foam springs of adjacent rows are in a uniform, immediately juxtaposed arrangement in 2 dimensions of said overlay.

17. The foam overlay of claim 13, wherein said foam springs cover greater than about 90 percent of the area of said rectangular base.

18. The foam overlay of claim 13, wherein the width of said longitudinal and lateral channels is approximately $\frac{1}{4}$ inch.

19. The foam overlay of claim 18, wherein said rectangular base block of said foam springs has a generally square cross-section with sides approximately 2 inches in length.

20. The foam overlay of claim 19, wherein said first plurality of foam springs have a height of approximately $1\frac{1}{2}$ inches and said second plurality of foam springs have a height of approximately 1 inch above said foam base.

21. The foam overlay of claim 13, wherein said first plurality of foam springs include a polyhedron extending upwardly from said rectangular base block having planar trapezoidal faces which terminate in said planar support surface.

* * * * *

UNITED STATES PATENT AND TRADEMARK OFFICE

Certificate

Patent No. 4,901,387 Patented: Feb. 20, 1990

On petition requesting issuance of a certificate for correction of inventorship pursuant to 35 USC 256, it has been found that the above-identified patent, through error and without any deceptive intent, improperly sets forth the inventorship.

Accordingly, it is hereby certified that the correct inventorship of this patent is: John K. Luke and William H. Pouch.

Signed and Sealed this Eighteenth-Day of Febraury, 1992.

RENEE S. LUEBKE

*Supervisory Patent Examiner*
*Art Unit 3508*